US012405029B2

(12) United States Patent
Cook et al.

(10) Patent No.: US 12,405,029 B2
(45) Date of Patent: Sep. 2, 2025

(54) ECO-FRIENDLY BOILER

(71) Applicants: Graham Arthur Cook, Broadmeadows (GB); Joshua Samuel Way, South Normanton (GB)

(72) Inventors: Graham Arthur Cook, Broadmeadows (GB); Joshua Samuel Way, South Normanton (GB)

( * ) Notice: Subject to any disclaimer, the term of this patent is extended or adjusted under 35 U.S.C. 154(b) by 0 days.

(21) Appl. No.: 18/723,559

(22) PCT Filed: Nov. 25, 2022

(86) PCT No.: PCT/GB2022/052995

§ 371 (c)(1),
(2) Date: Jun. 24, 2024

(87) PCT Pub. No.: WO2023/118781

PCT Pub. Date: Jun. 29, 2023

(65) Prior Publication Data

US 2024/0418405 A1 Dec. 19, 2024

(30) Foreign Application Priority Data

Dec. 22, 2021 (GB) ..... 2118758

(51) Int. Cl.
*F24H 1/50* (2022.01)
*F24H 15/457* (2022.01)

(52) U.S. Cl.
CPC ..... *F24H 1/50* (2013.01); *F24H 15/457* (2022.01); *F24H 2250/12* (2013.01)

(58) Field of Classification Search
None
See application file for complete search history.

(56) References Cited

U.S. PATENT DOCUMENTS 4,288,674 A * 9/1981 Councell ..... F22B 1/281 219/401
4,967,052 A * 10/1990 Krapf ..... H05B 6/804 165/104.19
5,322,603 A * 6/1994 Kameda ..... A61L 2/06 204/158.21

(Continued)

FOREIGN PATENT DOCUMENTS

CN 204388336 U 6/2015
CN 107388217 11/2017

(Continued)

OTHER PUBLICATIONS

Translation DE4128103A1.*

(Continued)

*Primary Examiner* — Edelmira Bosques
*Assistant Examiner* — Deepak A Deean
(74) *Attorney, Agent, or Firm* — Barnes & Thornburg LLP; G. Peter Nichols

(57) ABSTRACT

The claimed invention provides an eco-friendly alternative to traditional gas boilers, specifically the claimed invention provides a boiler that uses microwaves as a means to heat water within a boiler system. Preferably the water enters the boiler via one or more spray nozzles to produce a plurality of droplets or mist, which is then heated when they are exposed to the generated microwaves within the boiler.

15 Claims, 5 Drawing Sheets

(56) References Cited

U.S. PATENT DOCUMENTS

Figure 1:
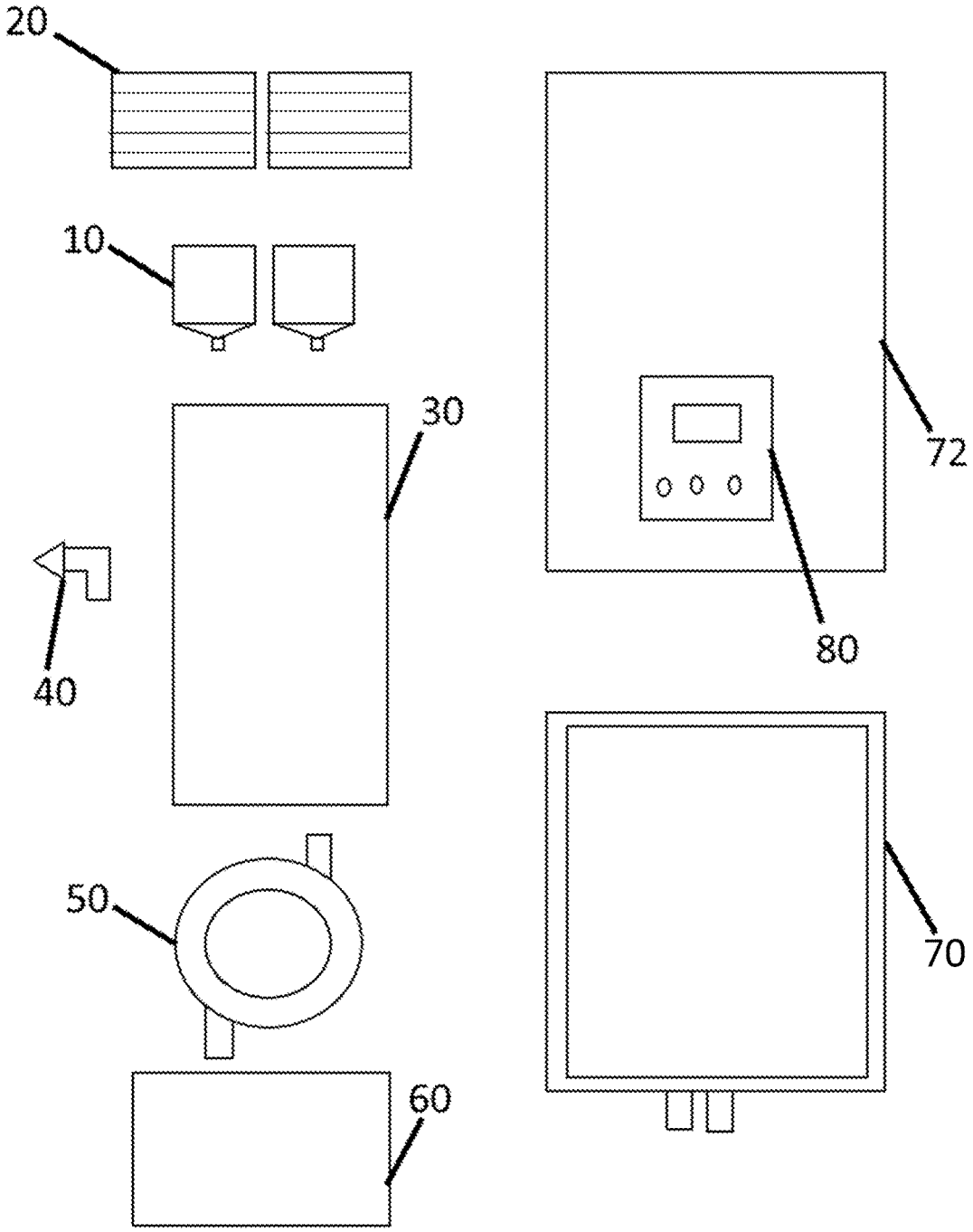

| | | | | |
|---|---|---|---|---|
| 5,387,780 | A * | 2/1995 | Riley | H05B 6/70 219/757 |
| 7,109,453 | B1 * | 9/2006 | Nadolski | H05B 6/802 219/688 |
| 7,465,907 | B1 * | 12/2008 | Martino | F24H 1/225 219/688 |
| 2004/0149742 | A1 * | 8/2004 | Lescano | H05B 6/802 219/688 |
| 2008/0283520 | A1 * | 11/2008 | Monteleone | F22D 3/06 219/688 |
| 2017/0225094 | A1 * | 8/2017 | Ju | B01D 1/20 |
| 2021/0278093 | A1 * | 9/2021 | Green | F24H 1/14 |
| 2021/0352782 | A1 * | 11/2021 | Carson | F27D 11/12 |

FOREIGN PATENT DOCUMENTS

| | | |
|---|---|---|
| DE | 4128103 | 2/1993 |
| DE | 102010027054 | 1/2012 |
| EP | 1746864 | 1/2007 |
| WO | 88/01826 | 3/1988 |

OTHER PUBLICATIONS

Int'l Preliminary Report on Patentability issued in PCT/GB2022/052995 (Nov. 30, 2023).
Search Report & Written Opinion issued in PCT/GB2022/052995 (Feb. 16, 2023).

* cited by examiner

ECO-FRIENDLY BOILER

This application is a U.S. nationalization under 35 U.S.C. § 371 of International Patent Application No. PCT/GB2022/052995, filed Nov. 25, 2022, which claims priority to United Kingdom application no. GB 2118758.8, filed Dec. 22, 2021; the entire contents of each are incorporated herein by reference.

BACKGROUND

With the rising demand for people and companies to reduce carbon emissions, and to reduce climate change, there is a growing need to find eco-friendly alternatives in many technological fields. One such technology that requires an eco-friendly alternative is the gas boiler used in many homes in the UK and abroad. These boilers are used to provide hot water and central heating, wherein the boiler comprises a water tank that is heated via a gas burner to produce heated water that can then be used around the home. Such gas burners will burn natural gas producing greenhouse gases such as carbon dioxide ($CO_2$), and possibility other pollutants and hazardous materials such as carbon monoxide (CO).

In an effort to reduce the use of gas boilers, there has been research into possible alternatives. One such alternative would be an electric boiler, which uses electric heating elements to heat the water in the boiler tank. As these boilers do not use natural gas, they produce fewer carbon emissions. However, such boilers may use a lot of power, and therefore if such boilers were used on masse the increased power demand needed to run all of the electric boilers, may result in power stations having to use more fuel to meet demand and therefore would still produce harmful emissions. Another alternative is the use of heat pumps, which uses heat exchanges to either pump heat into the house from the external environment or may be used to cool the home by pumping heat out of the home, into the external environment. There are different forms of heat pumps such as water-based, air-based, and geothermal depending on the environment/source the heat pump is pumping heat from. The air-based heat pump is the most likely to be used as the other can only be used in specific locations that provide the necessary environment, such as a geothermal heat source. The problem with such heat pumps is that they are affected by their environment, as they require heat from the environment to heat the home, so if they are used in an area with a colder climate there may not be sufficient heat to warm the boiler effectively.

CN107388217A, CN204388336U, and U.S. Pat. No. 4,288,674A disclose water heating apparatus wherein the water is heated using microwaves. WO8801826A1 discloses a central heating boiler for use in domestic and office systems wherein what is heated using microwaves for distribution to space heating radiators.

Therefore, there is a need for an eco-friendly alternative to the commonly used gas boiler, that does not require large amounts of power to operate and can be easily used in any environment.

SUMMARY

The present invention in its various aspects is as set out in the appended claims.

The claimed invention provides a boiler, which may be termed an eco-friendly boiler, comprising:

a water tank (30), wherein a portion of the water tank comprises a spray chamber, one or more spray nozzles (40), configured to spray water into the spray chamber of the water tank (30), and one or more microwave generators (10), coupled to the spray chamber, configured to emit microwaves towards the water emerging from the spray nozzles (40), wherein the boiler comprises two water tanks (30), wherein one tank is configured to supply hot water, such as for washing, and the other is configured to supply hot water for central heating.

As such the claimed invention provides an eco-friendly alternative to traditional gas boilers, specifically the claimed invention provides a boiler that uses microwaves as a means to heat water within a boiler system. Said microwaves are produced by low-power microwave generators, coupled to the boiler. Additionally, to improve the effectiveness of this microwave-based heating, the water would preferably enter the boiler through one or more spray nozzles, this will help separate the water into droplets, which will increase the surface area of the water that is exposed to the generated microwaves. Thereby increasing the likely hood of the microwaves being absorbed, with the absorption of the microwaves producing heat that will warm the water in the boiler.

DRAWINGS

Figure 2:
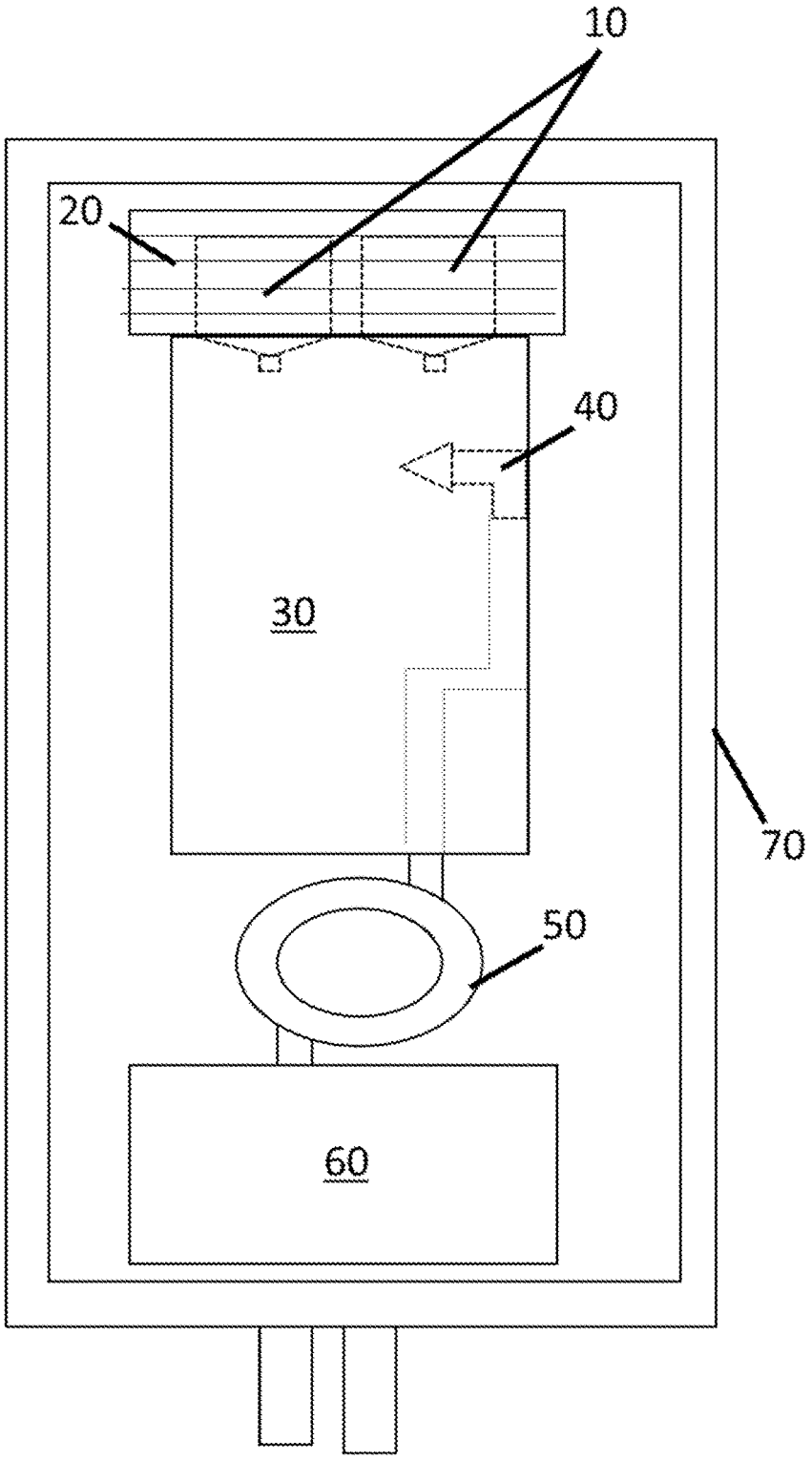

FIG. 1: shows a blow-up view of the components used to form the claimed invention FIG. 2: shows an example boiler as per the claimed invention.

Figure 3:
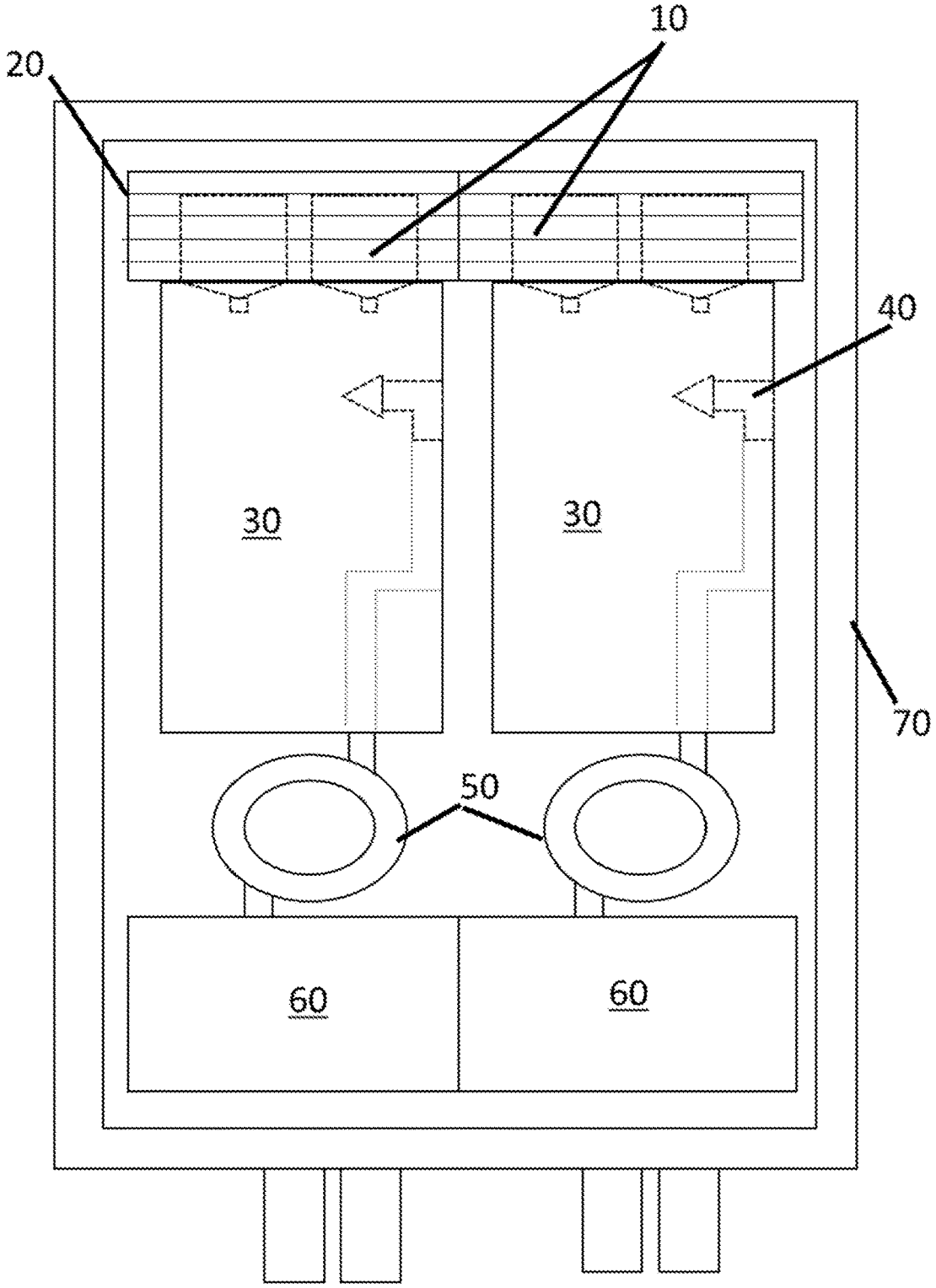

FIG. 3: shows an example boiler as per the claimed invention, which uses a two-tank system.

Figure 4:
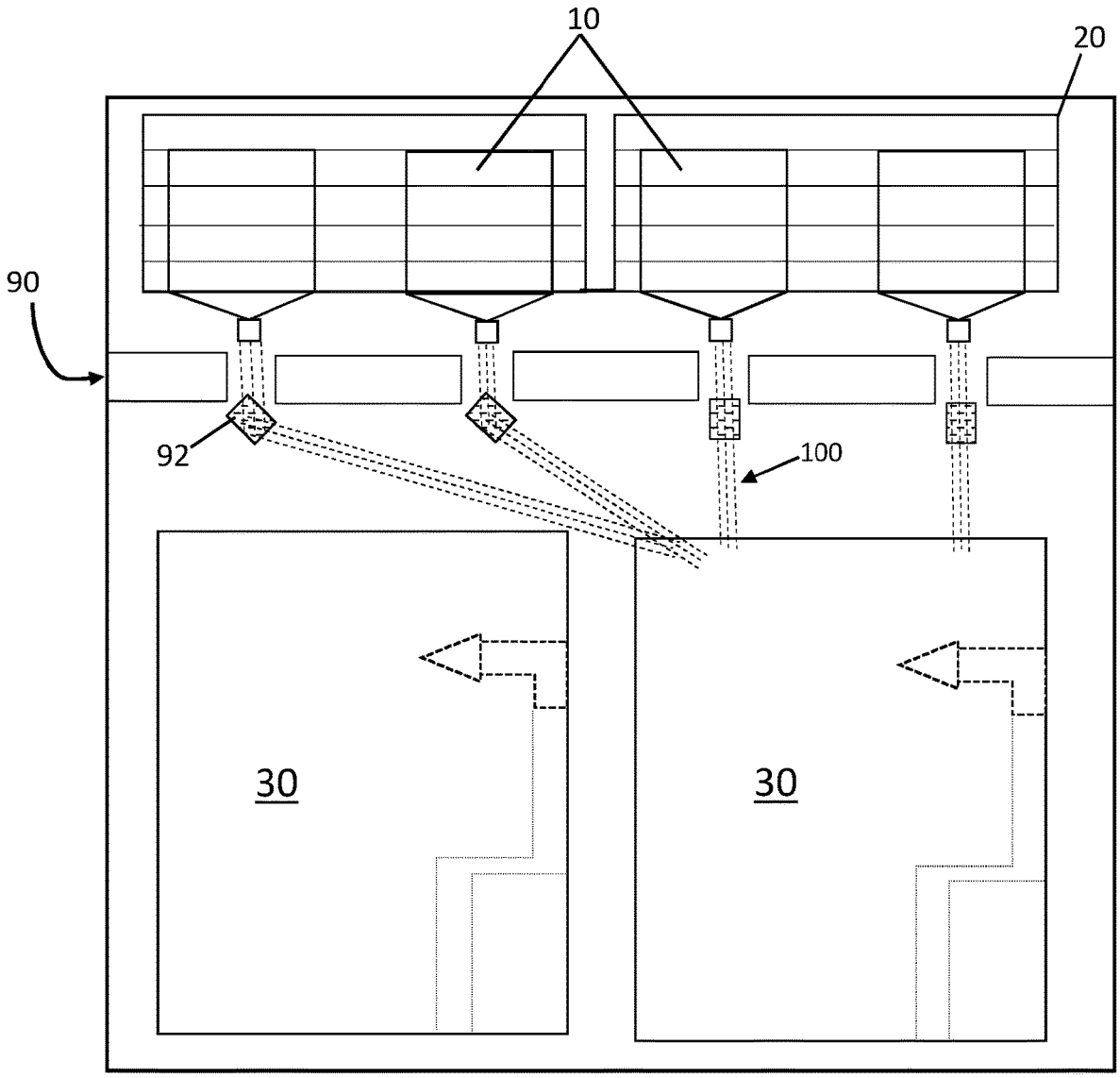

FIG. 4: shows an example boiler using a waveguide layer to direct the generated microwaves inside the boiler.

Figure 5:
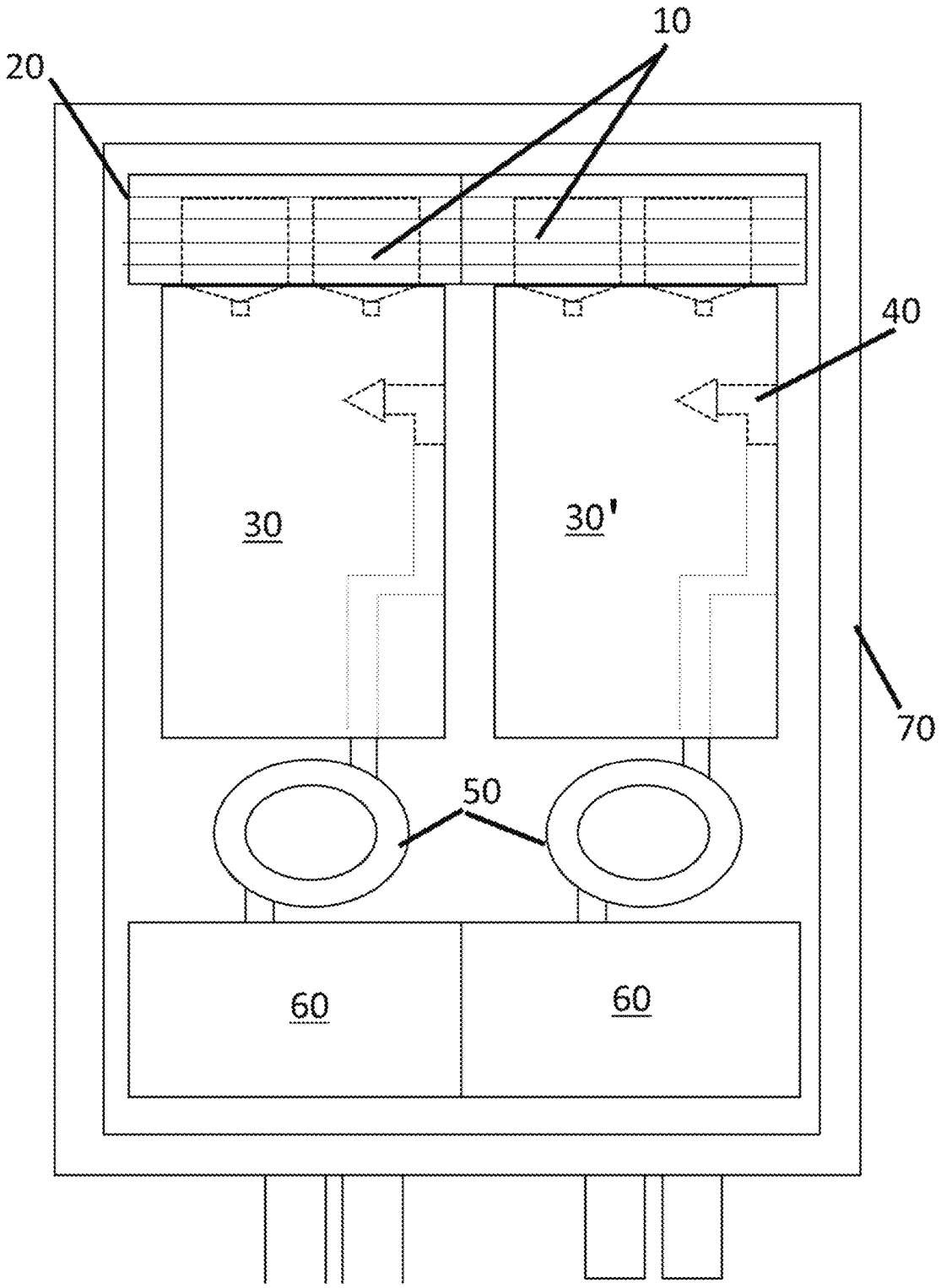

FIG. 5 shows an alternative example of a boiler as per the claimed invention

THE DEPICTIONS OF THE PRESENT INVENTION COMPRISE THE FOLLOWING PARTS

10—microwave (MW) generators
20—protective shielding
30—tank
30'—second tank
40—spray nozzle
50—pump
60—transformer
70—Housing
72—Housing front plate
80—control panel
90—wave guide layer
92—reflective block
100—microwaves

DETAILED DESCRIPTION

The claimed invention provides a microwave-heated boiler, as an eco-friendly alternative to the traditional gas boiler, wherein the microwave boiler comprises the following components, as depicted in FIGS. 1 and 2:

Microwave (MW) generators 10: the invention utilizes one or more microwave generators 10, as a means of heating the water inside the boiler tank 30, as the water absorbs the microwaves. More specifically the microwaves are used to heat the water as it enters the boiler tank 30, as the water would preferably enter the boiler as a mist or spray of droplets, these droplets increase the total surface area of the water, thereby increasing the probability of the microwaves being absorbed. The MW generators 10 may be coupled to the sides of the boiler tank or the top of the boiler tank. The MW generators 10 may be in the form of a magnetron, or a solid-state microwave generator, of these options the solid-state generator would be preferable as they are able to produce the same amount of radiation as the magnetron using less power, in some cases, the solid-state generators may run on only a wall outlet without the need for special cabling. It is also noted that solid-state generators also have a longer working lifespan, working for 50,000 hours around 10 times the expected lifespan of the magnetron, also the solid-state generator is likely mounted to a circuit with smaller dimensions and certainly less weight when compared to a magnetron with the same output. Note that each generator may comprise an emitter mounted to the side of the generator facing the water tank, to direct the generated microwaves towards the water, while the remaining sides may be encased in a layer of shielding 20, to help prevent the generated microwave from leaking into the surrounding environment, by including both the emitter and the shielding, the microwave generated by each generator can be directed into the boiler tanks with no risk of escaping to the boiler's surroundings. In operation the MW generators 10 may be able to provide continuous heating, changing the intensity, and/or amplitude, of the microwaves generated in order to control the temperature of the water in the tank 30, for example, a lower intensity being used for lower temperatures, or may instead operate periodically activating to raise the water temperature to a desired value before deactivating again, in this mode it is likely that the microwaves will be generated at a higher intensity/amplitude to heat the water rapidly.

It is noted that regardless of the mode used, this method of heating water provides a greener alternative to current gas boilers, and may require less power to operate compared to electric water heating. In some cases, the power from a standard wall outlet may be sufficient to run the one or more MW generators 10 attached to the boiler, in other cases, the boiler may come with its power supply, such as a solar panel, regardless of the method used the claimed boiler does not require a large amount of power to operate. Additionally, as the MW generators 10 do not produce any emissions, therefore the microwave boiler is more eco-friendly and also does not need to be ventilated, meaning the boiler does not need to be mounted to an external wall, and can instead operate from anywhere in the home with a suitable power supply.

Additionally, the boiler may be configured to generate high-pressure steam, said steam may be used when the boiler is powered by a turbine as a means to keep said turbine turning in an emergency, wherein power to the turbine is interrupted/lost. In these cases, the boiler is configured to pump a portion of the heated water back through the spray nozzle, thereby exposing this portion of water to additional heating, to further heat the water to produce steam. Note that in some cases the heated water may be pumped to a secondary tank 30', or a secondary spray chamber, inside which it will be heated again to form steam. In some cases, the secondary tank/spray chamber may be smaller to increase the pressure of the steam held within. These embodiments may also cycle the portion of heated water through the spray nozzles of the main or secondary tank/spray chamber multiple times in order to heat the water to a sufficient temperature to produce a sufficient quantity of steam. As this steam will only be needed in emergencies it is preferable to have the ability to store the steam until it is needed, additionally, if the steam is stored within the same tank as the heated water the steam may interfere with the heating process as the steam may become dense enough to shield the droplets that are sprayed into the water tank. For these reasons it would be preferable to include the secondary tank to store the steam until it is needed, note that this secondary tank may continuously cycle the portion of water fed into the tank to constantly heat this portion of water to prevent it from cooling/condensing.

One or more MW generators 10 may also be part of a microwave generating unit. Wherein each unit comprises one or more MW generators 10, with shielding 20 and an emitter for each generator, the units may also comprise control systems for each of the generators 10 to control the output of the emitters, such as changing the magnitude, or intensity, of the emitters' output, or change the emitters' modes from a constant output to a pulsed output. It is noted that the constant wave output would allow the boiler to constantly heat the water within the boiler, providing a means to heat the water after it is pooled within the bottom of the water tank 30, however, the intensity of the microwaves will be relatively low compared to the pulsed output so the rate of the temperature increase within the water, and therefore the heating process, may be slower when compared to the pulsed output. Whereas the pulsed output provides short intense bursts that may provide a faster rate of energy absorption, and therefore a faster heating process, but may be less penetrative than the constant wave, meaning the pulses may be less effective at keeping the water in the water tank 30 warm as it cannot penetrate the pooled water. As both modes have their benefits the user may choose the mode, they find most desirable, or in cases where the boiler includes multiple MW generators 10, the user may set different generators to different modes, to gain the benefits of each. The units may also include one or more sensors for monitoring the generators 10 which may detect faults in the unit, fans for cooling the generator components to prevent overheating, and/or a power input for powering the components of the unit, which may allow the unit to be disconnected from the power source in order to be safely removed it from the boiler, during maintenance or when a fault is detected by the sensor. It should also be noted that instead of air-cooling the MW generators 10, the units may include a water-cooling system or other suitable cooling systems, like those found in computers. However, one embodiment of the cooling system may use the water flowing into the water tank 30 as the cooling medium within the cooling system. Preferably this water would pass over the microwave units just before being sprayed into water tank 30, as this is likely when the water is at its coolest temperature, meaning the temperature difference between the water and the components of the generator units will be at its greatest, this higher temperature gradient may improve the rate of heat transfer between the unit and the water, thereby allowing more heat to be transferred to the water. Such a cooling system will also help in improving the efficiency of the water heating process within the boiler by using the microwave units to pre-heat the water before entering the water tank 30, as the process of heating the water with microwaves is not dependent on a heat gradient this pre-heating would not lower the rate of energy transfer within the tank but may help bring the water to a higher temperature. This method improves the efficiency of the boiler, as it allows heat that would otherwise be wasted by the MW generators 10 to be repurposed to pre-heat the water as it enters one of the tanks 30. In doing so the system may reduce the time and energy required to heat the water to the desired temperature, and may allow the water to reach a higher temperature in a given amount of time, due to the heat transfer between the microwaves and the water being mostly independent of the temperature of the water.

It should also be noted that a benefit of using such units, is that should a unit fail, it can be easily removed and replaced with a working unit, after which the faulty unit may be disposed of, or sent to be repaired. This Makes it easier for the user to do repairs to the boiler when necessary and means the user does not need to go for long periods without hot water while waiting for repairs.

Spray nozzles 40: to improve the effectiveness of the MW generator-based heating the boiler may utilize one or more spray nozzles 40. Wherein the nozzles 40 are configured to spay the water entering the boiler tank 30 to form droplets, or a fine mist, which can then be heated by the microwaves, after which the heated water pooling together at the bottom of the boiler tank 30 is ready to be used. This process helps to improve the effectiveness of the microwave hearting, as each droplet is a separate volume of water that will require significantly less energy to heat, these droplets also increase the amount of surface area that is exposed, thereby increasing the chances of the generated microwaves being absorbed. This is especially true when compared to a system that tries to heat all of the water in the tank at once, as the greater volume would mean more energy is required to heat the water to a desired temperature, increasing the power consumption of the boiler. Additionally, when the water is pooled at the bottom of the tank, the microwaves may only be able to penetrate a certain depth of the water, as the water at the top of the tank may be shielding the water beneath, meaning that only the top of the water is being heated, and the rest of the water would be heated slowly via convection currents, which would mean the process of heating the water in the boiler to a desired temperature would take significantly more time. Therefore, by heating a spray of water, the water in the boiler can be heated faster and would require less energy to reach the desired temperature. Note that it may also be possible to have the microwaves continue to heat the sprayed water once it has pooled at the bottom of the tank, but as the water is already heated this process would be more efficient due to the lower temperature difference between the sprayed water and the pooled water.

Similar to the MW generators 10, the spray nozzle 40 may be mounted to the sides or top of the tank 30, though it is noted the nozzle 40 should preferably be in a position perpendicular to the position of the microwave generators 10, as this may help improve the overlap between the emitted microwaves and the water flow from the nozzle. Thereby improving the efficiency of the heating process, by ensuring the largest possible volume of the sprayed water is exposed to the generated microwaves. It is noted that different types of nozzles may be utilized to get different spray patterns, for example, the nozzle 40 may be configured to produce a flat splay, thereby shaping the water into a thin sheet to again improve exposure to the microwaves, as the thin sheet ensures the microwaves can fully penetrate the sprayed water. In some cases, the nozzles 40 may produce a course flow, for though a course flow would spray the water in a larger volume, which runs the risk of the microwaves not fully penetrating the sprayed water, such a flow may help to bypass or remove any blockages with the nozzle itself. Thereby providing the boiler with a means of removing any blockages that form, without the need to remove the nozzle from the boiler. In some cases, the nozzles 40 may be configured to produce a cone spray, such a spray would also ensure that the water enters the boiler tank as a thin layer for improved penetration, but would potentially also inject a greater volume of water at once providing a more efficient flow, this flow would be preferred when the water is sprayed from the top of the tank, in such cases MW generators 10 may be mounted on opposite sides of the flow, to help ensure that one side of the cone does not block the microwaves from the other side of the water flow. And in some embodiments the nozzle 40 may be configured to produce a fine mist, thereby reducing the volume of the water droplets in the flow, and increasing the surface area of the droplets, thereby further reducing the energy needed to heat them, though such a mist may cover a large volume, or be so dense, to the point where the droplet furthest from the MW generators 10 may not be heated in time, as it is shielded by the rest of the mist. It is, noted that in any case, as much of the surface area of the sprayed water must be exposed to the microwaves as possible, as there will be little to no convection to transfer heat between the droplets, and though this can be achieved by using a high number of smaller volume droplets, with little spacing between them, there must be a balance to ensure the droplets do not shield one another from the microwaves, therefore it is preferred that the spray chamber/portion of the water tank that received the water from the nozzle houses a relatively low volume of water at a given time, therefore it may be considered that the flat or cone spay may be preferable as the shape of the flow ensures there is little to no shielding between droplets, though at a low pressure the mist spray may be preferable as it produces the smallest droplets and therefore exposes the largest surface area.

Regardless of which nozzle design is used, it is noted that the nozzles 40 would preferably be towards the top end of the water tank 30, in order to increase the path, the sprayed water has to travel before reaching the pool of water at the bottom of the tank. In doing so, the boiler may increase the likelihood of the sprayed water being heated before pooling with the rest of the water, as the droplets or mist will be exposed to the microwave for a greater time, thereby increasing the probability of the individual droplets absorbing sufficient microwaves to be heated by the time it reaches the bottom of the water tank. It is also noted that the water tank 30 should not be filled with water, as if it was there would be no room to produce the desired spray described above. Additionally, when there is more open space within the tank 30, there will be a longer path the sprayed water will need to travel before reaching the pooled water, therefore the more space in the water tank the higher the probability that the generated microwaves will be absorbed by a water droplet, for this reason, it may be preferable to have the water tank be no more than half full at any given time. Alternatively, the water tank may include a separate spray chamber, wherein the spray nozzles 40 spray water into the spray chamber to be heated before the heated water flows into the water tank 30.

Pumps 50 and water tanks 30: the boiler may also comprise one or more pumps 50 for pumping the water in and out of the boiler, similar to most boiler designs. However, in most traditional boilers the pumps used are designed to output a large volume, typically with a lower pressure output. Such pumps may not be suitable for the claimed system as the nozzles 40 will require a relatively high pressure to create the required spray. Therefore, the claimed boiler may use a high-pressure pump for pumping the water in and out of the tank. Alternatively, the boiler may use a plurality of pumps, which includes at least one low-pressure pump for pumping water around the system in a high volume, and at least one smaller high-pressure pump for pumping water into the spray nozzles 40 to increase the pressure of the water flowing to the nozzles 40, to ensure the nozzles can produce a fine spray, as the water enters the tank 30.

In some embodiments, the boiler may comprise a single water tank 30 as depicted in FIG. 2, for receiving the heater water, to be stored before use, as previously mentioned this water tank 30 may also include a spray chamber for receiving and heating the sprayed water before storing the heated water in the water tank 30. The boiler of the present invention comprises two tanks 30, as depicted in FIG. 3, one for producing hot water for water systems, such as taps and showers, and a separate tank for producing hot water for a central heating system. By using two tanks 30, the boiler can supply both systems simultaneously, without the need to prioritize one system over the other, meaning that using hot water from outlets such as sinks and showers does not affect the central heating system, and vice versa. Note that in such a two-tank system the boiler will require at least two pumps 50, one for each tank 30. And in some embodiments, there may be a need for four pumps, comprising a low-pressure pump for moving a large volume of water through the respective system, and a smaller high-pressure pump for pumping water through the spray nozzles 40 of each tank 30.

Additionally, it is noted that each tank 30 used in the disclosed boiler should comprise a material that may either absorb or reflect the generated microwaves or may have a coating on the inside of the tank made from such materials so that the generated microwaves do not escape the tank 30. It is noted that by using the reflective material the microwaves may be reflected towards the water in the tank 30 to improve the efficiency of the heating process, by exposing more of the water to the generated microwaves, thereby increasing the chance of the microwave being absorbed. However, as mentioned the casing, or the inner lining, may be made of a material that will absorb the microwaves instead, this will result in the casing of the water tank 30 heating up, and may therefore provide heat to the water in the boiler, especially to the pooled water that the microwaves may not be able to penetrate. In the cases wherein the tank 30 is made of a material that absorbs the excess microwaves, the boiler may comprise a series of pipes that pass the water over the sides of the tank 30 before it reaches the spray nozzles 40, this way the water can absorb heat from the tank to pre-heat the water before it enters the water tank, this can prevent the tank 30, from overheating and improve the heating process by reducing the time/energy needed to heat the water to the desired temperature.

Also as mentioned the claimed boiler requires the water entering the boiler to be sprayed into droplets, or a mist before being heated by the microwaves, therefore the one or more water tanks 30 may require a spray chamber, this may be a portion of the water tanks volume or a separate chamber that then feeds the heated water into the water tank. As previously mentioned, it is preferable for the boiler to have a means of keeping the water warm after it has pooled in the water tank, usually by having the water tank exposed to the generated microwaves, therefore of these options, it is preferable that the spray chamber be part of the water tank 30 itself. In particular, the water tank can be seen more as a canister wherein only a portion of the water tank 30 will be filled at a given time, the empty portion of the water tank will be coupled to the spray nozzle and will act as the spray chamber. To achieve this the water tank 30 would preferably only hold enough water to fill about half the tank or less, when the water pools at the bottom of the tank, wherein the spray nozzles will spray the droplets or mist into the empty top half of the chamber to be heated by the microwaves. It should also be noted that when a spray chamber is used it may be preferable for the spray chamber to be made of, or lined with a material that can reflect microwaves, allowing the unabsorbed microwaves to be redirected toward the sprayed water, to increase the chance of absorption.

It should also be noted, that each of the pumps 50 and tanks 30 used in the boiler may be designed to couple with a range of different water pipes. Allowing the user to maintain the pipes to their current boiler, and simply couple them to the new tank 30/pumps 50, when installing the claimed boiler, thereby allowing easy installation. It should also be noted that similar to the MW generators 10, the pumps 50 and water tanks 30 may comprise their units that can be easily coupled to, or removed from, the boiler, and therefore may be easily replaced if they are faulty.

In systems that comprise more than one tank 30, there may be a waveguide positioned between tanks 30 and the MW generators 10. Wherein the waveguide is configured to direct the microwaves emitted from the MW generators 10 to one or both of the tanks 30. Wherein the waveguide is configured to switch the path of the microwaves so that when a tank 30 is not in use the output of the MW generators 10 coupled to the said tank is redirected to the tank that is in use, this way the system can ensure that no energy is wasted generating microwaves that are not needed, and can improve the output of the system by concentrating all of the MW generators 10 onto a single tank 30. The waveguide may also be used to direct the generated microwaves to a specific portion of the tank, for example, the microwaves could be directed to the lower portion of the tank when the water level within the tank falls below a predetermined threshold, allowing the system to focus the microwaves on locations that would increase the rate heat is being transferred to the water. In the preferred embodiment this wave guide would comprise a plurality of fibre like cables, similar to fibre-optic cables, as this wave guide can be easily shaped to ensure the waveguide outputs are positioned at the desired locations in the boiler, further each cable, or group of cables would have a separate input allowing the user to more easily directed to the required waveguides by switching on or off the MW generator outputs coupled to each input.

Though this is the most preferable design for the waveguide other designs may also be used, such a wave guide block which comprises one or more elongated channels formed within in a metal, or dielectric material. Wherein one end of the elongated channel receives the microwaves emitted by one of the MW generators 10, the hollow cavity of the channels then guides the microwaves to the desired location at the other end of the channel, in the case of the disclosed boiler this location would be a specific location on, or portion of one of the boiler tanks 30. These channels may be formed by folding sheet metal into a hollow shape, or by moulding and/or shaping a dielectric material into the desired hollow shape. Of these options the folded sheet metal may be preferable as not only is the folded metal easier to shape, it may also be actuated, or bend, while in use to redirect the microwaves within the waveguide, with less risk of breaking. The wave guide may have other means of redirecting the microwaves within the channel such as a reflecting block where the angle of the block relative to the elongated axis of the waveguide channel determines the direction of travel for the microwaves within the wave guide. Wherein the waveguide is capable of switching outputs by rotating one or more reflective blocks, and/or actuating walls within the wave guide structure to direct the microwaves to a desired target, allowing the microwaves to be directed to one or both of the boiler tanks 30.

Power supply: In order to use the above-mentioned pumps 50 and microwave generators 10 the claimed boiler requires a power supply. In some embodiments this power may be supplied from a standard wall outlet, which feeds electricity into a step-up transformer 60, which may be mounted within the boiler, that will then output the required power to the pumps 50 and microwave generators 10. Note that in embodiments wherein the boiler has multiple tanks 30, there may be a separate transformer 60 for each tank 30, each supplying power to the pumps 50 and microwave generators 10 of their respective tanks 30. In other embodiments the boiler may have its own power supply, such as a solar panel, that may also feed power into a transformer 60 within the boiler before powering the pumps 50 and/or MM generators 10, though such external power supply may be able to generate the necessary power for the boiler without the need for the above-mentioned transformers 60. In some cases, the boiler may be powered by a turbine, in such cases as previously mentioned the boiler may be configured to produce steam in order to turn the turbine in the case of an emergency when power has been interrupted or lost until the power returns to normal, this system may require an additional tank/chamber for storing and generating said steam.

Outer casing/housing 70: the boiler should preferably include an outer casing/housing 70 which would house the above-mentioned boiler components, such a housing 70 may help make the boiler more aesthetically pleasing, and may also prevent water leaking from the boiler from entering the external environment, should one of the tanks 30, nozzles 40 or pipes within the boiler begin to leak. This outer casing may also be made from a material that could shield the surroundings from the microwaves generated by the MW generators 10, by being made from a material that can absorb such microwaves or a material that may reflect the microwaves towards the water tanks 30. The housing 70 may instead have a lining on the inside of the housing 70 made of a material that can absorb the microwaves or reflect them towards the water tank 30, using such a lining may help to reduce the overall weight of the housing 70, when compared to an entire housing made from the same material. It should be noted that the housing 70 may be removable, or have a removable front panel 72, to allow the user to access the different components within the housing more easily.

Control system: The boiler features a control system that may be coupled to the boiler, remote from the boiler, or preferably a combination of both, thereby providing additional redundant control means should one of the control systems fail. The claimed boiler may feature a display mounted to the water tank 30 or housing 70, to show the status of the boiler, as well as controls coupled to the display, or the surrounding housing, for controlling the water temperature and water levels within the tank 30. It is noted that these controls may also be remote from the boiler itself. In these cases, the controls may comprise a mobile hub or controller, that would comprise the above-mentioned display and boiler controls, which can control the boiler remotely, possibly through a Wi-Fi connection, or an internet of things (IoT) connection. In other cases, the mobile controls may be in the form of an application on the user's mobile devices, such as a smartphone, smartwatch, or laptop. These mobile control systems will allow the user to monitor and control the boiler regardless of their current location, though the boiler may as mentioned still have manual controls on the boiler itself as a backup control system. Also, in systems that utilize generator units with monitoring sensors, the control system may be configured to alert the user to any detected faults within the microwave generator units, and may also be configured to control the outputs of the MW generators 10 and/or generator units.

Some experimentation has been done using a system as described above. The results of this experiment showed that the system could achieve a wide range of temperatures over a short time scale, in particular, a system with a single generator that was coupled to a single radiator could heat room temperature water within the radiator to 25 degrees in less than 15 mins, and up to 50 degrees is under 50 min (47 mins) showing an improved rate of heat exchange, especially at higher temperatures. In a further experiment wherein, the preferred system was used with the output changed to three radiators the system could heat the water in all three radiators to around 48 degrees within 26 mins and maintained a constant temperature as the water circulated through the radiators.

FIG. 4 depicts an example of how the above-mentioned boiler with the addition of a waveguide, in this case a waveguide layer 90 due to the use of multiple MW generators 10. These wave guides would be configured to direct the microwaves, represented by the lines 100, from the MW generators 10 to one of the tanks 30. Wherein the waveguides would further comprise a means of switching the direction of the microwaves between the two tanks 30. In the depicted example the waveguide comprises a layer of metal, alloy or dielectric material with a plurality of channels, wherein each channel is configured to receive the microwaves emitted from a respective MV generator output, wherein the walls of the channel would guide the microwaves to one of the tanks 30 allowing the waves to be focused onto the tank to reduce the amount of energy being loss as the microwaves travel through the boiler. Further in this example each of the channels contain a reflective block 92, wherein the block 92 is configured to allow the microwaves to pass straight through the block when it is aligned with the waveguide 90 channel. However, the blocks 92 may be rotated in order to reflect the microwaves in a desired direction, in this case reflecting the microwaves 100 towards one of the tanks 30. This may be used in situations where one of the tanks is not needed, or when the temperature in one tank is insufficient, in either case the microwaves are guided towards the desired tank 30 to increase the amount of energy, and in turn heat, the water in that designated tank 30 receives. This ensures that energy from the generated microwaves is not wasted on water that does not need to be heated. Note that the design in FIG. 4 is just one example of a waveguide that can be used, other examples may replace the reflective blocks 92, with actuating channel walls, wherein the walls of the waveguide channels can be angled to reflect the microwaves towards one or both of the tanks 30. In another example the waveguide layer 90 may be replaces with a plurality of wave guide fibres which reflect the microwaves, the same way an optical fibre reflects light, wherein the fibres may be actuated to redirect the microwaves towards the desired tank 30, alternatively the fibres may be arranged in groups, or bundles, each directed towards a specific tank 30, or portion of a tank, with a respective input to receive microwaves from the MW generators 10, wherein the MW generators 10 would activate different output channels coupled to a respective fibre bundle, or wherein the boiler includes a waveguide to direct the microwaves from the MW generator 10 to the desired fibre bundle input. Note that in this case the waveguide may use reflective block and/or actuating walls to guide the microwaves as described above.

By using the above-mentioned boiler system, the claimed invention provides an eco-friendly alternative to gas boilers. By using microwave generators to heat the water within the boiler, wherein the microwave generates uses electricity and has a low power consumption, the boiler does not produce carbon emissions and has a reduced carbon footprint when compared to other gas boiler alternatives. By using such a boiler, the user removes the need for a gas feed, this prevents the risk of gas build-up or gas leaks which can be hazardous to the users. The removal of the gas feed also allows the boiler to be mounted in places that a conventional gas boiler cannot, as there is no need for the boiler to be mounted to an external wall for gas ventilation. Therefore, the claimed boiler provides an improved system over conventional gas boiler.

The term 'eco-friendly boiler' has been used herein, for the purposes of the present invention that term may be replaced by the term, 'boiler' in all instances.

The term 'central heating' is used herein in its meaning as a term of art in plumbing and not in the literal meaning of any heating that is in some way central. A central heating system provides warmth to a number of spaces within a building from one main source of heat, e.g., a boiler. In the present invention. The present invention is primarily directed to central heating in the form of circulating hot water can be used for central heating. Such a preferred system can be called hydronic heating system. The of supply hot water is used as a term of art in plumbing rather than any supply of water which is hot and refers to water heated for use external to the pipework (i.e. plumbing/system) in which it is supplied, for example, for use in washing or bathing, as for example supplied to a wash basin, sink, tap or shower.

The following numbered sentences further describe the present invention:

1. An eco-friendly boiler comprising:
   a water tank (30), wherein a portion of the water tank comprises a spray chamber, one or more spray nozzles (40), configured to spray water into the spray chamber of the water tank (30), and
   one or more microwave generators (10), coupled to the spray chamber, configured to emit microwaves towards the water emerging from the spray nozzles (40),
   wherein the boiler comprises two water tanks (30), and
   wherein one tank is configured to supply hot water, and the other is configured to supply central heating.
2. The boiler of sentence 1, wherein each water tank is coupled to a respective spray chamber, one or more microwave generators (10), one or more spray nozzle (40).
3. The boiler of sentence 1 or sentence 2, wherein the boiler further comprises a control system; the control system comprising a display and controls for controlling the boiler;
   wherein the control system comprises at least one of a remote control, controls coupled to the water tank (30), controls coupled to the housing (70), or an application configured to be installed on the user's mobile devices.
4. The boiler of any sentences 1 to 3, wherein the boiler is configured to pump a portion of the heated water back through the spray nozzles (40) to be further heated into steam.
5. The boiler of sentence 4, further comprising a secondary spray chamber or secondary water tank, wherein the portion of heated water is sprayed into the secondary spray chamber or secondary water tank, wherein it is heated into steam using one or more microwave generators (10) coupled to the secondary spray chamber or secondary water tank.
6. The boiler of any preceding sentence, wherein the spray chamber comprises an empty portion of the water tank (30) positioned at the top of the water tank (30).
7. The boiler of any preceding sentence wherein the spray chamber, spray nozzles (40), and microwave generators (10) are coupled to the top portion of the water tank (30).
8. The boiler of any preceding sentence wherein either the spray nozzles (40) or microwave generators (10) are coupled to the top of the spray chamber, with the other coupled to the sides of the spray chamber.
9. The boiler of any preceding sentence wherein the one or more spray nozzles (40) comprise at least one of a flat spray nozzle, a cone spray nozzle, a coarse spray nozzle, or a mist spray nozzle.
10. The boiler of any preceding sentence wherein the water tank (30) is made of, or lined with, a material suitable to reflect microwaves, to redirect the microwaves towards the water in the spray chamber.
11. The boiler of any preceding sentence wherein the water tank (30) is made of, or lined with, a material suitable for absorbing microwaves, to absorb excess microwaves from the microwave generators (10) to heat the water tank (30).
12. The boiler of any preceding sentence, wherein the boiler further comprises one or more pumps (50), to move water in and/or out of the boiler.
13. The boiler of any preceding sentence, wherein the boiler comprises at least two pumps (50), the at least two pumps comprising one or more low pressure pump configured to pump water in and out of the tank (30), and one or more high pressure pumps configured to pump water into the spray nozzles (40).
14. The boiler of any preceding sentence, wherein the boiler further comprises a power supply to power the microwave generators (10) and pumps (50).
15. The boiler of sentence 14, wherein the power supply is coupled to a transformer (60), wherein the transformer (60) transfers power from the power supply to the pumps (50) and microwave generators (10).
16. The boiler of any preceding sentence, wherein the microwave generators (10), are in the form of a removable microwave generator unit, said unit comprising:
    One or more microwave generators (10),
    A shielding layer (20),
    Controls for the microwave generators (10).
17. The boiler of sentence 16 wherein the microwave generator unit further comprises one or more sensors configure to monitor the generator unit and alert the user to faults within the unit.
18. The boiler of sentence 16 or 17 wherein the microwave generator units further comprise a cooling system, wherein the cooling system comprises pipes which passes the water over the microwave generator units, before entering the spray chamber.
19. The boiler of any preceding sentence wherein the microwave generators (10), or microwave generator units, can adjust at least one of the amplitude, intensity, or frequency of the generated microwaves; and/or
    wherein the microwave generators (10) can produce either a constant wave output or a pulsed output.
20. The boiler of any proceeding sentence, wherein the components of the boiler are modular, so that any of the water tank (30), microwave generators (10), spray nozzles (40), spray chamber, microwave generator units, pumps (50), or transformers (60), can be removed and replaced.

21. The boiler of any preceding sentence wherein the boiler further comprises a housing (70).

22. The boiler of sentence 21, wherein the housing (70) comprises one or more removable panels (72).

23. The boiler of sentences 217 and 22 wherein the housing (70) is made of, and/or lined with, a material suitable to reflect microwaves, to redirect the microwaves towards the water in the spray chamber.

24. The boiler of sentences 21 and 22 wherein the housing (70) is made of, and/or lined with, a material suitable to absorb microwaves, to generate heat that warms the water as it enters and leaves the boiler.

The invention claimed is:

1. A boiler comprising:

two primary water tanks, wherein a portion of each water tank comprises a spray chamber and one or more spray nozzles configured to spray liquid water into the spray chamber of the respective liquid water tank, and one or more microwave generators coupled to the spray chamber and configured to emit microwaves towards the water emerging from the spray nozzles, and wherein one primary water tank is configured to supply liquid hot water being water heated for use external to pipework in which it is supplied, and wherein the other primary water tank is configured for recirculating hot water supplying a hydronic central heating system.

2. The boiler of claim 1, wherein each primary water tank is coupled to a respective spray chamber, one or more microwave generators, and one or more spray nozzles.

3. The boiler of claim 1, wherein the boiler further comprises a control system; the control system comprising a display and controls for controlling the boiler; and wherein the control system comprises at least one of a remote control, controls coupled to the water tank, controls coupled to the housing, or an application configured to be installed as an application on a user's mobile devices.

4. The boiler according to claim 1, wherein the boiler is configured to pump a portion of the heated liquid water back through the spray nozzles to be further heated into steam.

5. The boiler according to claim 4, further comprising a secondary spray chamber and a secondary water tank, wherein the portion of liquid heated water is sprayed into the secondary spray chamber in the secondary water tank, wherein it is heated into steam using one or more microwave generators coupled to the secondary spray chamber or secondary water tank.

6. The boiler according to claim 1, wherein the spray chamber of at least one of the primary water tanks comprises an empty portion of each primary water tank positioned at the top of the at least one of the primary water tanks.

7. The boiler according to claim 1, wherein the spray chamber, spray nozzles, and microwave generators of each primary water tank are coupled to the top portion of the respective primary water tank.

8. The boiler according to claim 1 wherein either the spray nozzles or microwave generators are coupled to the top of the spray chamber of each primary water tank, with the other of the spray nozzles or microwave generators coupled to the sides of the spray chamber.

9. The boiler according to claim 1, wherein the one or more spray nozzles comprise at least one of a flat spray nozzle, a cone spray nozzle, a coarse spray nozzle, or a mist spray nozzle.

10. The boiler according to claim 1, wherein the water tank is made of, or lined with, a material suitable to reflect microwaves, to redirect the microwaves towards the water in the spray chamber.

11. The boiler according to claim 1, wherein the water tank is made of, or lined with, a material suitable for absorbing microwaves, to absorb excess microwaves from the microwave generators to heat the water tank.

12. The boiler according to claim 1, wherein the boiler comprises at least two pumps, the at least two pumps comprising one or more low pressure pump configured to pump liquid water in and out of the tank, and one or more high pressure pumps configured to pump liquid water into the spray nozzles.

13. The boiler according to claim 1, wherein the microwave generator units further comprise a cooling system, wherein the cooling system comprises pipes which passes the liquid water over the microwave generator units, before entering the spray chamber.

14. The boiler according to claim 1, wherein the microwave generators, or microwave generator units, can adjust at least one of the amplitude, intensity, or frequency of the generated microwaves; and/or wherein the microwave generators can produce either a constant wave output or a pulsed output.

15. The boiler according to claim 1, wherein the housing is made of, and/or lined with, a material suitable to absorb microwaves, to generate heat that warms the liquid water as it enters and leaves the boiler.

* * * * *